United States Patent [19]

Shimizu et al.

[11] Patent Number: 4,940,396

[45] Date of Patent: Jul. 10, 1990

[54] HERMATIC SCROLL TYPE COMPRESSOR WITH TWO CASINGS AND CENTER BLOCKS

[75] Inventors: Shigemi Shimizu, Sakai; Kazuto Kikuchi, Honjo; Kiyoshi Terauchi, Isesaki, all of Japan

[73] Assignee: Sanden Corporation, Japan

[21] Appl. No.: 296,596

[22] Filed: Jan. 13, 1989

Related U.S. Application Data

[63] Continuation-in-part of Ser. No. 169,983, Mar. 18, 1988, Pat. No. 4,900,238.

[30] Foreign Application Priority Data

Jan. 14, 1988 [JP] Japan ..... 63-6450

[51] Int. Cl.[5] ..... F04B 35/04; F04C 18/04; F04C 29/00

[52] U.S. Cl. ..... 417/410; 417/902; 418/55; 29/156.4 R; 29/464; 29/469; 29/888.022

[58] Field of Search ..... 417/410, 902; 418/55, 418/270; 29/156.4 R, 464, 466, 469

[56] References Cited

U.S. PATENT DOCUMENTS

| | | | |
|---|---|---|---|
| Re. 19,961 | 5/1936 | Crane | 417/902 |
| 801,182 | 10/1905 | Creux | 418/55 |
| 1,156,700 | 10/1915 | May . | |
| 1,934,155 | 11/1933 | Van Deventer | 417/902 |
| 3,463,091 | 8/1969 | Delsuc . | |
| 4,065,279 | 12/1977 | McCullough | 418/55 |
| 4,201,521 | 5/1980 | Carlson | 417/53 |
| 4,439,118 | 3/1984 | Iimori | 418/55 |
| 4,466,784 | 8/1984 | Hiraga | 418/104 |
| 4,560,330 | 12/1985 | Murayama et al. | 418/55 R |
| 4,609,334 | 9/1986 | Muir et al. | 418/55 B |

FOREIGN PATENT DOCUMENTS

| | | | |
|---|---|---|---|
| 59925 | 9/1982 | European Pat. Off. | 418/55 |
| 58-172485 | 10/1983 | Japan | 418/55 |
| 61-116089 | 6/1986 | Japan | 418/55 |
| 61-226587 | 10/1986 | Japan | 418/55 E |
| 61-265380 | 11/1986 | Japan | 418/55 R |
| 61-291793 | 12/1986 | Japan . | |
| 62-113881 | 5/1987 | Japan | 418/55 R |

*Primary Examiner*—John J. Vrablik

*Attorney, Agent, or Firm*—Banner, Birch, McKie & Beckett

[57] ABSTRACT

A hermetic type scroll compressor includes a hermetically sealed compressor housing formed by first and second cup shaped casings. The first casing houses a compression mechanism, while the second casing houses a drive mechanism. The compression mechanism includes a fixed scroll affixed to the first cup shaped casing, an orbiting scroll interfitted at an angular and radial offset with the fixed scroll, and a rotation preventing device disposed between the orbiting scroll and the center block. The movement of both the compression and driving mechanisms may be inspected or tested and those mechanisms may be readily disassembled so that component parts thereof may be adjusted or replaced before hermetically securing the first casing to the second casing. Furthermore, each casing is provided with a center block forming, in part, an alignment mechanism for aligning the drive mechanism drive shaft with the orbiting scroll of the compression mechanism.

16 Claims, 1 Drawing Sheet

HERMATIC SCROLL TYPE COMPRESSOR WITH TWO CASINGS AND CENTER BLOCKS

This application is a continuation-in-part application of co-pending U.S. patent application Ser. No. 169,983 filed Mar. 18, 1988, U.S. Pat. No. 4,900,238.

TECHNICAL FIELD

The present invention relates to a scroll type compressor and more particularly, to a motor driven scroll compressor having the compression and driving mechanisms within a hermetically sealed housing.

BACKGROUND OF THE INVENTION

Scroll type fluid displacement apparatus are well known in the prior art. For example, U.S. Pat. No. 801,182 issued to Creux discloses such an apparatus which includes two scrolls, each having a circular end plate and a spiroidal or involute spiral element. The scrolls are maintained angularly and radially offset so that both spiral elements interfit to form a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets increases or decreases, dependent on the direction of the orbital motion. Thus, a scroll type fluid displacement apparatus may be used to compress, expand or pump fluids.

Furthermore, U.S. Pat. No. 4,560,330 to Murayama et al., for example, discloses a hermetic scroll compressor which includes a compression mechanism having a fixed scroll, an orbiting scroll associated with a rotation preventing device, and a driving mechanism therefor in one sealed container. In this hermetic type scroll compressor, the essentially inseparable container is hermetically sealed, for example, by welding, so that leakage of refrigerant from the container is prevented. While the above mentioned hermetically sealed scroll compressor prevents leakage of refrigerant from the container, it can be disassembled only by destructively opening the sealed container to, for example, repair, adjust or exchange internal parts. Furthermore, it is virtually impossible to dynamically test the compression and drive mechanisms before assembling the compressor components into the sealed container. Therefore, compressors found to be functionally defective after assembly thereof, often become scrap in view of the repair factors which may render repair cost-ineffective.

SUMMARY OF THE INVENTION

It is a primary object of this invention to improve hermetic type scroll compressor manufacturing by assembling a first casing and a second casing of a hermatic type scroll compressor separately so that the components in each casing may be disassembled, reassembled and inspected independently before permanently securing the first and second casings to form a hermatically sealed housing.

It is another object of this invention to provide an alignment mechanism for aligning the compression mechanism within the first casing with the drive mechanism within the second casing when assembling the compressor.

It is a further object of this invention to provide an alignment mechanism on one end of the compression mechanism and one end of the drive mechanism for aligning a dynamic testing device with either the compression mechanism or drive mechanism so that either mechanism may be easily aligned with the testing device and the time for testing procedures may be reduced.

The compressor construction of the present invention incorporates the separate compression and drive mechanisms and casings therefor as described in parent U.S. patent application Ser. No. 169,983 which is incorporated herein. U.S. patent application Ser. No. 169,983 discloses a hermetically sealed scroll compressor wherein the compressor housing includes two releasably secured casings to facilitate disassembly and reassembly of the compressor. Even though, the releasable construction improves cost efficiencies regarding inspection and repair, after the compressor has been assembled, the releasable seal may not sufficiently prevent leakage of refrigerant from the housing.

The casings of the present invention are fused to form the hermetically sealed housing and to more effectively prevent the aforementioned leakage. Even though the fusion joint prevents effective disassembly and thus repair of the internal components after the compressor has been assembled, the compressor and drive mechanisms retain their individual inspectability, testability and repairability during manufacture.

A hermatic type scroll compressor, according to a preferred embodiment of this invention, includes a hermetically sealed housing which houses a fixed scroll, an orbiting scroll, a driving mechanism for driving the orbiting scroll and a rotation preventing mechanism for preventing rotation of the orbiting scroll. The fixed scroll is fixedly disposed within the housing and includes an end plate from which a first wrap extends into the interior of the housing. The orbiting scroll has an end plate from which a second wrap extends. The first and second wraps interfit at an angular and radial offset to form a plurality of line contacts which define at least one pair of sealed off fluid pockets. The driving mechanism includes a motor supported in the housing and is operatively connected to the orbiting scroll to effect the orbital motion of the orbiting scroll. The rotation preventing mechhanism prevents rotation f the orbiting scroll during orbital motion thereof. The volumen of the fluid pockets changes when the orbiting scroll otbits to compress the fluid in the pockets.

According to the present invention, the housing includes a first cup shaped casing and a second cup shaped casing. The first cup shaped casing houses the fixed scroll, orbiting scroll and rotation preventing mechanism. The second cup shaped casing houses the driving mechanism which includes a drive shaft. The first and second cup shaped casings are fused together to form the hermetically sealed housing. A first center block is disposed within the first cup shaped casing and includes a front and rear surface. The rear suface is connected to a portion of the rotation preventing mechanism. A second center block is disposed within the second cup shaped casing and rotatably supports one end of the drive shaft. The second center block has a front surface which faces the front surface of the first center block, wherein engaging portions of the facing surfaces form an alignment mechanism for aligning the drive shaft with the orbiting scroll.

The present invention further includes a rear support block disposed within the second cup shaped casing. The rear support block supports the other end of the drive shaft and is releasably secured to the second center block.

Further objects, features and other aspects of this invention will be understood from the detailed description of the preferred embodiment of this invention with reference to the annexed drawings.

DETAILED DESCRIPTION OF THE PREFERRED EMBODIMENT

Figure 1:
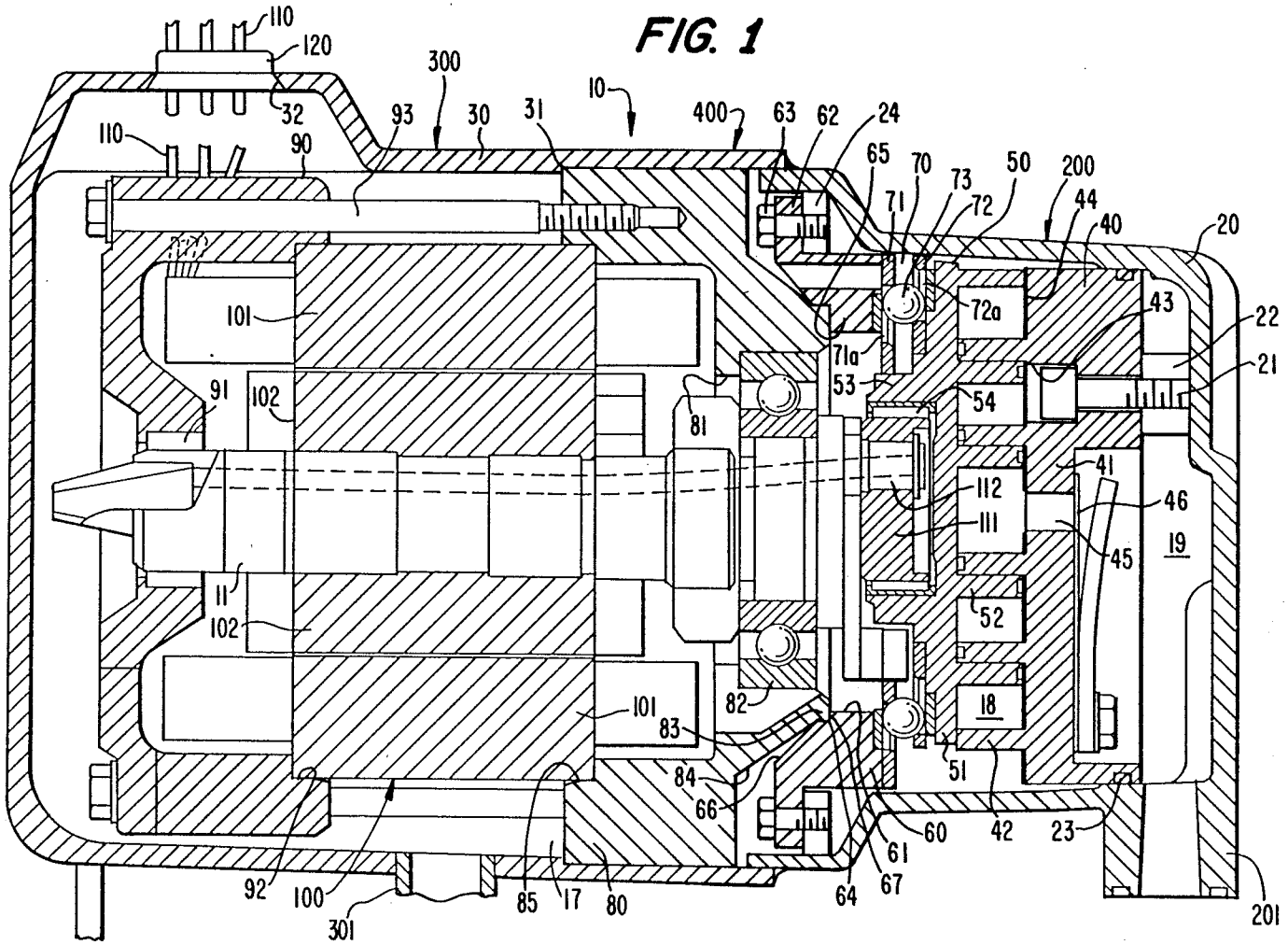
FIG. 1 is a vertical longitudinal sectional view of a hermetic type scroll compressor in accordance with a preferred embodiment of this invention.

FIG. 1 shows a hermetic type scroll refrigerant compressor 10 in accordance with a preferred embodiment of the invention. Compressor 10 includes compressor housing 400 which is formed by first cup shaped casing or shell 20 and second cup shaped casing or shell 30. First casing 20 houses the compression mechanism, while second casing 30 houses the driving mechanism. Casings 20 and 30 are joined or fused together to form compressor housing 400 and to hermetically seal the compression mechanism and driving mechanism therefor.

The compression mechanism comprises fixed scroll 40 which includes circular end plate 41 and wrap or spiral element 42 affixed to or extending from one end surface of end plate 41. Fixed scroll 40 is fixedly secured to first cup shaped casing 20 by fasteners or screws 21, so that fixed scroll 40 is fixedly positioned within an inner chamber of first casing 20. Screws 21 are screwed into inner axial projection 22, projecting from an inner bottom surface of casing 20, through holes 43 formed in end plate 41. Anti-wear plate 44 is disposed on one end surface of end plate 41 and covers an opening to each hole 43. O-ring seal 23 is disposed between an outer peripheral surface of circular end plate 41 and an inner peripheral surface of first cup shaped casing 20 to seal a mating surface therebetween. Accordingly, circular end plate 41 partitions the inner chamber of first cup shaped casing 20 into two chambers, i.e., front chamber 18 and near chamber 19.

With reference to FIG. 1, orbiting scroll 50 is disposed to the rear or right side of first center block 60 which includes central bore 61 and flange 62 projecting radially outwardly from an outer peripheral surface of block 60. Orbiting scroll 50 incudes circular end plate 51 and wrap or spiral element 52 affixed to or extending from one end surface of circular end plate 51. Annular projection 53 is formed opposite the surface of circular end plate 51 from which spiral element 52 extends. Bearing 54 is disposed within an inner peripheral wall of annular projection 53.

Rotation preventing/thrust bearing device 70 is placed between and connected to the rear end surface of first center block 60 and the end surface of circular end plate 51. Rotation preventing/thrust bearing device 70 includes first ring 71 attached to the rear end surface of first center block 60, second ring 72 attached on the end surface of circular end plate 51, and a plurality of bearing elements, such as balls 73, placed between pockets 71*a* and 72*a* formed by rings 71 and 72. The rotation of orbiting scroll 50 is prevented by the interaction of balls 73 with rings 71 and 72. Also, the axial thrust load from orbiting scroll 50 is supported on first center block 60 through balls 73. Therefore, while orbiting scroll 50 orbits, the rotation of orbiting scroll 50 is prevented by rotation preventing/thrust bearing device 70.

Spiral element 52 of orbiting scroll 50 interfits spiral element 42 of fixed scroll 40 at an angular offset of 180° and at a predetermined radial offset. Spiral elements 52 and 42 define at least one pair of sealed off fluid pockets between their interfitting surfaces.

Once both spiral elements 52 and 42 are placed in an interfitting position, first center block 60 is fixed within the inner chamber of first cup shaped casing 20 by securing flange 62 to a plurality of inner radial projections 24 with screws 63. Projections 24 radially extend from the inner surface or inner wall of casing 20 and may be formed therewith or secured thereto.

After assembly, first cup shaped casing 20 houses the compression mechanism and forms compression mechanism section 200 therewith. Compression mechanism section 200 comprises first center block 60 and the construction to the right thereof as shown in FIG. 1. More specifically, compression mechanism section 200 includes first cup shaped casing 20 having first center block 60, fixed scroll 40, orbiting scroll 50 and rotation preventing/thrust bearing device 70 therein.

Second center block 80 fits firmly within second cup shaped casing 30 and is positioned against ridge 31 which is formed in an inner wall of second casing 30. Second center block 80 rotatably supports one end of drive shaft 11 in bore 81 of second center block 80 through bearing 82. Busing 111 is attached to one end of drive shaft 11 at a radial offset through pin member 112. The other end of drive shaft 11 is rotatably supported by rear support block 90 through bearing 91. Stator 101 of motor 100 is held between and supported by second center block 80 and rear support block 90 which include annular support grooves 85 and 92 formed therein for supporting the motor. Motor 100 also includes rotor 102 which rotates with shaft 11. Rear support block 90 is releasably secured to second center block 80 by through-bolts 93 which may be threaded. These releasable securing mechanisms permit the driving mechanism, which comprises rear support block 90, motor 100 and second center block 80, to be easily assembled or disassembled prior to insertion into second cup shaped casing 30.

Wires 110 extend from stator 101 and pass through hermetic seal base 120 for connection with an electrical power source (not shown). Hermetic seal base 120 is hermetically secured to second cup shaped casing 30 about hole 32 which is formed at the side surface of second cup shaped casing 30. For example, base 120 may be welded or brazed to casing 30 to provide the hermetic seal therebetween.

After assembly, second cup shaped casing 30 houses the driving mechanism and forms driving mechanism section 300 therewith. Driving mechanism section 300 comprises second center block 80 and the construction to the left thereof as shown in FIG. 1. More specifically, driving mechanism section 300 includes second cup shaped casing 30 having second center block 80, motor 100 including shaft 11, and rear bearing block 90 therein.

Once compression mechanism section 200 and driving mechanism section 300 have been assembled, these sections may be inspected and then joined to form compressor 10. When sections 200 and 300 are fitted together, the facing surfaces of first center block 60 and second center block 80 form an alignment mechanism for aligning drive shaft 11 with orbiting scroll 50.

First center block 60 includes annular portion 65 having annular recess 64 formed in an inner wall thereof. With reference to FIG. 1, recess 64 is formed at the front or left end of the inner wall which forms bore 61. Recess 64 also includes abutment surface 67 which is substantially normal to the center line of shaft 11 when sections 200 and 300 are joined. Front end surface or guide surface 66 of first center block 60 extends radially outwardly from annular recess 64. Surface 66 is preferably frustoconical. However, surface 66 may be dish-shaped with a concave curvature or it may have other suitable curvatures, such as a convex curvature, for slidingly guiding second center block 80 therealong and toward annular recess 64.

Second center block 80 includes annular projection 83 having an outer diameter slightly smaller than the diameter of annlular recess 64, so that projection 83 may securely interfit with recess 64 when the first and second center blocks are brought into engagement. As can be seen in FIG. 1, abutment surface 67 prevents annular projection 83, whcih is formed at the front or right end of second block 80, from penetrating within first cup shaped casing 20 beyond first center block 60. The front surface of second block 80 includes portion 84 which extends radially outwardly from annular projection 83. Portion 84 is shown as being frustoconical and as having a slope less than the slope of surface 66 with respect to the center line of shaft 11. The difference in slope provides a space between surfaces 66 and 84 and prevents excessive interference therebetween when joining sections 200 and 300. However, portion 84 may have other curvatures, such as convex or concave curvatures, which would provide such a space between surfaces 66 and 84.

Therefore, when sections 200 and 300 are being joined to form compressor 10, front end surface 66 may guide or center annular projection 83 into annular recess 64. Projection 83 and recess 64 further form an alignment mechanism for aligning drive shaft 11 with orbiting scroll 50. Accordingly, bushing 111 is inserted into annular projection 53 of circular end plate 51 so as to attach drive shaft 11 to orbiting scroll 50 at a radial offset. Orbiting scroll 50 is rotatably supported by bushing 111 through bearing 54 disposed within the inner peripheral wall of annular projection 53. Both open ends of first and second cup shaped casings 20 and 30 are closed as annular projection 83 and recess 64 are fitted. Then sections 200 and 300 are hermetically joined by a suitable means, such as welding or brazing, to form compressor 10 with hermetically sealed compressor housing 400.

During manufacture, a static or dynamic testing device (not shown) may be used to inspect compression mechanism section 200 or driving mechanism section 300 before joining those sections to form compressor housing 400. For such testing, projection 83 or recess 64 also may form an alignment mechanism for aligning the testing device with the driving or compression mechanism sections. For example, a testing device for testing compression mechanism section 200 may be provided with a projection similar to projection 83 for engagement with annular recess 64 of first center block 60. Once the testing device is interfitted with compression mechanism section 200, section 200 may be statically or dynamically inspected. In a similar manner, driving mechanism section 300 may be inspected or tested.

The operation of compressor 10 will be described hereafter. Once motor 100 is energized, stator 101 generates a magnetic field and rotor 102 rotates, thereby rotating drive shaft 11. This rotational motion is transferred to orbital motion through bushing 111. Therefore, orbiting scroll 50 orbits, but rotation of orbiting scroll 50 is prevented due to rotation prevention/thrust bearing device 70. Refrigerant gas is introduced into inner chamber 17 of second cup shaped casing 30 through inlet port 301 which is formed at the side wall of second cup shaped casing 30, and flows through front chamber 18 of first cup shaped casing 20 through bearing 82 and then through rotation preventing/thrust bearing device 70. The refrigerant gas in front chamber 18 is taken into the sealed fluid pockets between fixed scroll 40 and orbiting scroll 50. Then refrigerant is forced toward the center of the spiral wraps during the orbital motion of orbiting scroll 50 with resultant voluem reduction and compression. The compressed refrigerant is discharged into rear changer 19 through hole 45 and one-way valve 46. Finally, the discharged refrigerant in rear chamber 19 flows to an external fluid circuit (not shown) through outlet port 201.

Although an illustrative embodiment of the invention has been described in detail with respect to the accompanying drawing, it is to be understood that the invention is not limited to one precise embodiment, and that various changes and modifications may be effected therein by one skilled in the art without departing from the scope of the invention.

We claim:

1. In a scroll type compressor with a hermetically sealed housing, the compressor comprising a fixed scroll fixedly disposed within said housing and having an end plate from which a first wrap extends into the interior of said housing, an orbiting scroll having an end plate from which a second wrap extends, said first and second wraps interfitting at an angular and radial offset to form a plurality of line contacts which define at least one pair of sealed off fluid pockets, a driving mechanism including a motor supported in said housing, said driving mechanism being operatively connected to said orbiting scroll to effect the orbital motion of said orbiting scroll, rotation prevention means for preventing the rotation of said orbiting scroll during orbital motion thereof, whereby the volume of the fluid pockets changes during said orbital motion to compress the fluid in the pockets, the improvement comprising:

said housing including a first cup shaped casing and a second cup shaped casing, said first cup shaped casing housing said fixed scroll, said orbiting scroll and said rotation prevention means, said second cup shaped casing housing said driving mechanism which further includes a drive shaft, wherein said first and second cup shaped casings are joined to form said hermetically sealed housing;

a first center block being disposed within said first cup shaped casing, said first center block having a front surface and a rear surface, said rear surface being connected to a portion of said rotation preventing means;

a second center block being disposed within said second cup shaped casing and rotatably supporting one end of said drive shaft, said second center block having a front surface facing said first center block front surface; and alignment means formed on engaging portions of said facing surfaces of said first and second center blocks for aligning said drive shaft with said orbiting scroll, said alignment means comprising an annular recess formed at an inner portion of said first center block and an annular projection formed on said second block, said alignment means further comprising a guide surface formed on said front surface at said first center block for guiding said second center block therealong and towards said annular recess, said guide surface extending radially outwardly from said annular recess.

2. The hermetically sealed scroll compressor of claim 1 wherein said annular recess includes an abutment surface for preventing said annular projection from penetrating beyond said first center block within said first cup shaped casing, said abutment surface being substantially normal to the center line of said drive shaft.

3. The hermetically sealed scroll compressor of claim 1 wherein said guide surface is frustoconical.

4. The hermetically sealed scroll compressor of claim 3 wherein said front surface of said second center block comprises a frustoconical portion extending radially outwardly form said annular projection.

5. The hermetically sealed scroll compressor of claim 1 wherein said first center block is releasably secured to said first cup shaped casing.

6. The hermetically sealed scroll compressor of claim 5 wherein said first cup shaped casing includes at least one projection extending radially inwardly from an inner wall of said first cup shaped casing, said first center block being releasably secured to said at least one projection.

7. The hermetically sealed scroll compressor of claim 5 wherein said first and second center blocks are entirely disposed within said hermetically sealed housing.

8. The hermetically sealed scroll compressor of claim 1 wherein said second cup shaped casing further houses a rear support block which rotatably supports the other end of said drive shaft, said rear support block being releasably secured to and solely supported by said second center block.

9. The hermetically sealed scroll compressor of claim 1 wherein the center line of said drive shaft and the center of said orbiting scroll are radially offset.

10. The hermetically sealed scroll compressor accordign to anyone of claims 1, 2, or 3 through 11 wherein said first and second cup shaped casings are fused together to form said hermetically sealed housing.

11. In a scroll type compressor with a hermetically sealed housing, the compressor comprising a fixed scroll fixedly disposed within said housing and having an end plate from which a first wrap extends into the interior of said housing, an orbiting scroll having an end plate from which a second wrap extends, said first and second wraps interfitting at an angular and radial offset to form a plurality of line contacts which define at least one pair of sealed off fluid pockets, a driving mechanism including a motor supported in said housing, said driving mechanism being operatively connected to said orbiting scroll to effect the orbital motion of said orbiting scroll, rotation preventing means for preventing the rotation of said orbiting scroll during orbital motion thereof, whereby the volume of the fluid pockets changes during said orbital motion to compress the fluid in the pockets, the improvement comprising:

said housing including a first cup shaped casing and second cup shaped casing, said first cup shaped casing housing said fixed scroll, said orbiting scroll and said rotation preventing means, said second cup shaped casing housing said driving mechanism which further includes a drive shaft, wherein said first and second cup shaped casings are fused together to form said hermetically sealed housing;

a first center block being disposed within said first cup shaped casing and being releasably secured thereto;

a second center block being disposed within said second cup shaped casing and rotatably supporting one end of said drive shaft; and a rear support block being disposed within said second cup shaped casing, said rear support block supporting the other end of said drive shaft and being releasably secured to and solely supported by said second center block.

12. The hermetically sealed scroll compressor of claim 11 wherein said motor is held between and supported by said second center block and said rear support block.

13. The hermetically sealed scroll compressor of claim 12 wherein said rear support block is releasably secured to said second center block by through-bolts.

14. The hermetically sealed scroll compressor of claim 11 wherein said first center block includes a rear surface connected to a portion of said rotation prevention means.

15. The hermetically sealed scroll compressor according to any one of claims 11 through 14, wherein said first and second cup shaped casings include a weld therebetween to form said hermetically sealed housing.

16. The hermetically sealed scroll compressor according to any one of claims 11 through 14 wherein said first and second cup shaped casings include a brazed joint therebetween to form said hermetically sealed housing.

* * * * *